United States Patent [19]

Yamada

[11] 4,427,404

[45] Jan. 24, 1984

[54] APPARATUS FOR STACKING A TAPE OF INDEFINITE LENGTH IN FOLDED CONDITION

[75] Inventor: Yasuo Yamada, Kurobe, Japan

[73] Assignee: Yoshida Kogyo K. K., Tokyo, Japan

[21] Appl. No.: 330,945

[22] Filed: Dec. 15, 1981

[30] Foreign Application Priority Data

Dec. 25, 1980 [JP] Japan ..... 55-182900

[51] Int. Cl.[3] ..... B65H 45/20

[52] U.S. Cl. ..... 493/414; 493/411; 19/160; 19/163; 28/291

[58] Field of Search ..... 493/409–415, 493/448, 957, 967; 226/118–119; 53/116–117, 429; 19/160, 163; 28/291; 270/39

[56] References Cited

U.S. PATENT DOCUMENTS

| | | | |
|---|---|---|---|
| 2,939,306 | 6/1960 | Terhune | 493/414 |
| 3,707,063 | 12/1972 | McIntyre | 493/414 X |
| 3,747,162 | 7/1973 | Watson | 19/163 |
| 3,917,250 | 11/1975 | Branick | 53/116 X |

FOREIGN PATENT DOCUMENTS

| | | | |
|---|---|---|---|
| 628109 | 3/1936 | Fed. Rep. of Germany | 493/409 |
| 42-26440 | 12/1967 | Japan | 19/160 |

*Primary Examiner*—A. J. Heinz

*Attorney, Agent, or Firm*—Hill, Van Santen, Steadman & Simpson

[57] ABSTRACT

An apparatus for stacking a tape of indefinite length in folded condition by shaking the tape off into an accumulation box. When the height of the tape stacked goes above the top of the accumulation box, the top of the tape stack is pressed down to increase the compactness of the tape stack resulting in increase in the amount of tape stacked in the accumulation box.

11 Claims, 9 Drawing Figures

APPARATUS FOR STACKING A TAPE OF INDEFINITE LENGTH IN FOLDED CONDITION

BACKGROUND OF THE INVENTION

This invention relates to an apparatus for stacking and accumulating a tape of indefinite length such as a fastener tape, fastener chain or the like in folded condition and more particularly, to an apparatus in which when a tape of indefinite length is to be stacked and accumulated in folded condition within an accumulation box, at the completion of the accumulation step of the tape, the top of the tape stack in the box is pressed down to thereby increase the compactness of the tape stack resulting in substantial increase in the quantity of tape stacked in the accumulation box.

In the past, after the so-called dyeing process involving dyeing, water-rinsing and drying steps was completed, a tape strip of indefinite length was stacked in folded layers within an accumulation box and when the accumulation box was filled with the tape, the box was transferred to subsequent processing steps.

As means for folding and accumulating the tape, in general, a method in which the tape was reciprocally traversed along the rocking plate in the width direction thereof while shaking the tape off into the accumulation box was employed to stack the tape in the accumulation box in zigzag folded condition until the box was filled with the tape. Alternatively, a method in which the tape was folded into layers by a contact roller type transfer mechanism and as the thickness of the folded tape layers increases, the transfer mechanism was raised accordingly was employed. For example, the latter method is disclosed in Japanese Utility Model Publication No. 21832/77. However, in these methods, in order to increase the capacity of the box, no compression means to increase the compactness of the folded tape stack was employed. In the latter method, when the contact pressure of the roller means against the tape was increased upon transferring of the roller, the tape tended to cling about the roller which inevitably caused the operation to be interrupted. And such tendency is aggravated as the tape feed rate increases.

SUMMARY OF THE INVENTION

With the above-mentioned disadvantages inherent in the prior art in mind, the present invention is to provide a tape stacking and accumulating apparatus in which the tape is traversed while being shaken off to be stacked and accumulated in folded layers within an accumulation box. The top of the tape stack is pressed down from the top of the accumulation box without interfering with the tape shaking-off and folding operation to thereby form compact folded tape layers in the box under stabilized condition resulting in increase the amount of tape stacked in the accumulation box to several times that in the prior art, and further, the possibility of distortion and/or creasing of the tape which may be caused by local application of compressive force to the tape is eliminated.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

BRIEF DESCRIPTION OF THE DRAWINGS

The accompanying drawings show one preferred embodiment of apparatus for stacking an indefinite length of tape in folded layers constructed in accordance with the present invention in which.

PREFERRED EMBODIMENT OF THE INVENTION

Figure 1:
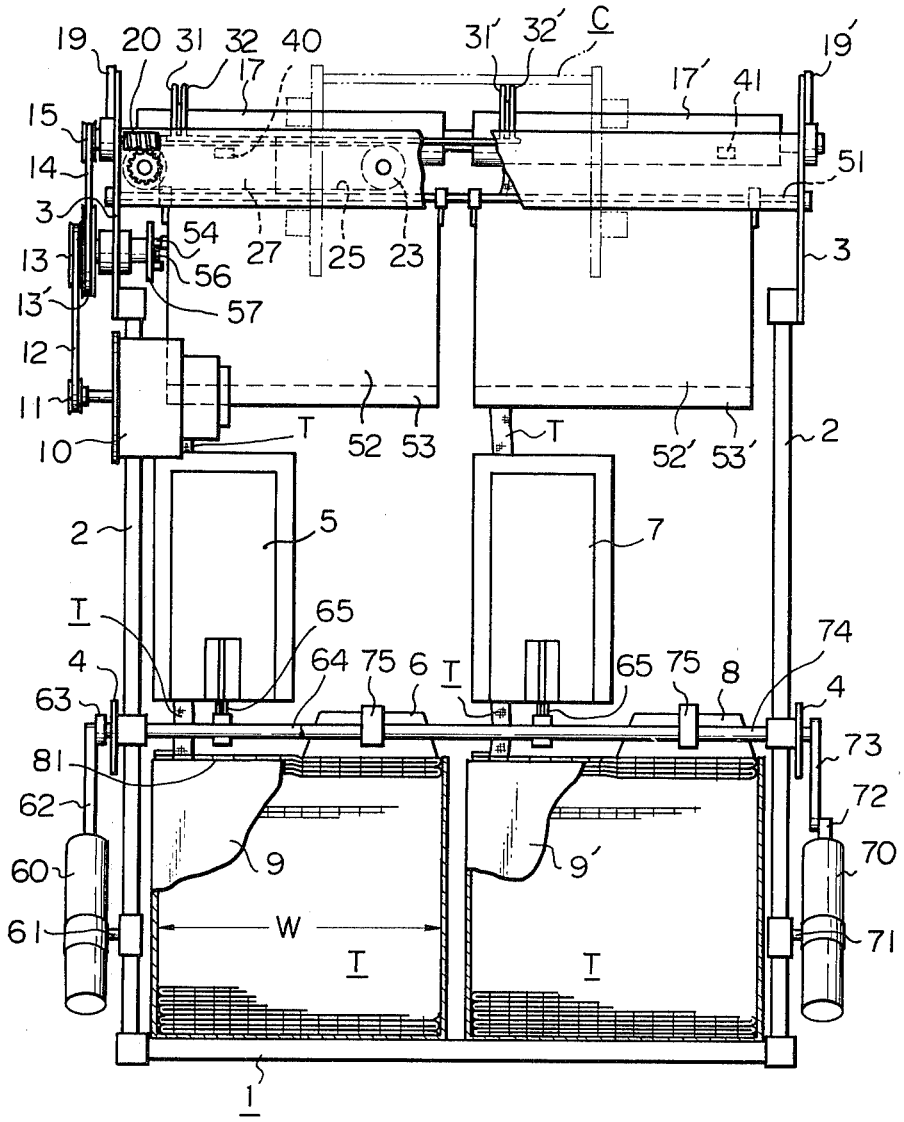
FIG. 1 is a front elevational view of said apparatus with a portion thereof cut away.

The present invention will be now described referring to the accompanying drawings in which one preferred embodiment of apparatus according to the present invention is illustrated. As shown in FIG. 1, in the illustrated embodiment, although two tapes T of indefinite length are shown to be stacked in their associated accumulation boxes 9, 9' in their folded condition, respectively, the present invention can be equally practiced in the case wherein one, three of more accumulation boxes are provided.

Figure 2:
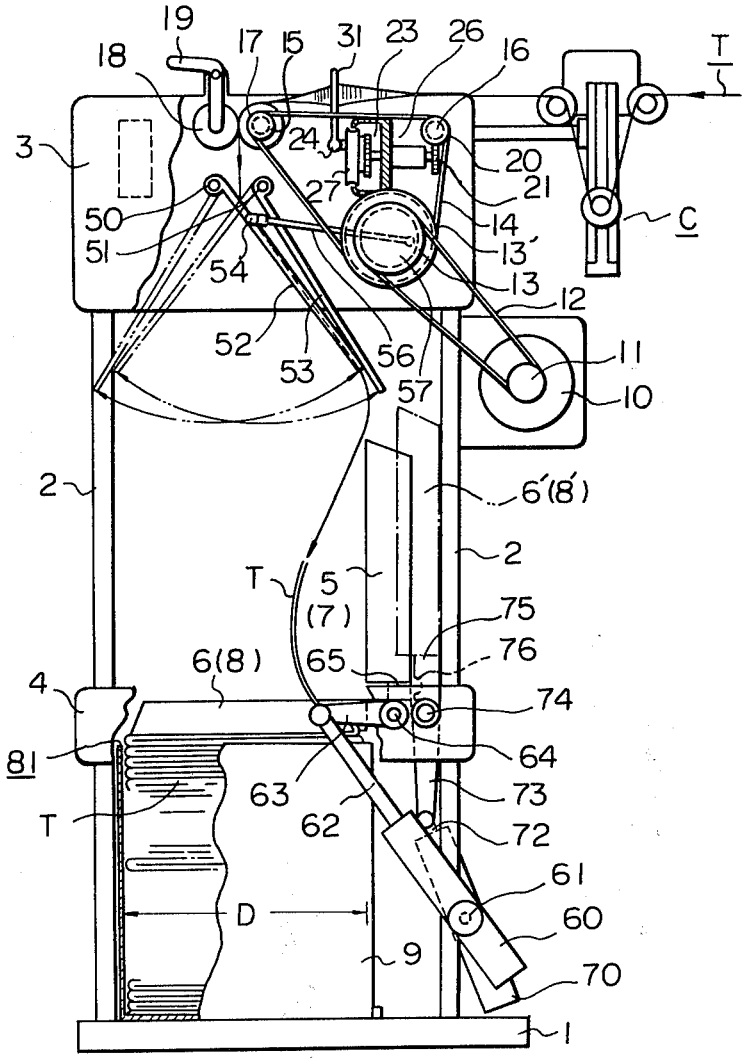
FIG. 2 is a side elevational view of said apparatus with a portion thereof cut away.

In FIGS. 1 and 2, reference numeral 1 denotes a square base machine and reference numeral 2 denotes vertical frames extending uprightly at the four corners of the square base 1. Upper and lower side frames 3, 4 are secured to the upper and lower portions of vertical frames 2, respectively, two tape accumulation boxes 9, 9' are mounted at a predetermined place on the base 1 between the side frames 4, 4 and have the width W and depth D (the depth is the dimension as measured from the front side to the rear side of the box).

Disposed on the upper side frames 3, 3 above the boxes 9, 9' are a nip roll assembly comprising a tape feed roll 17 adapted to be driven by a motor 10 and a pressure roll 18, a tape traverse mechamism and a tape shaking-off device comprising two rocking plates 52, 53 adapted to rock upon receipt of the tape from the nip roll assembly.

More particularly, as shown in FIG. 2, an endless belt 14 is wrapped or trained about a traverse mechanism drive pulley 16, a pulley 15 mounted on the feed roll 17 and a pulley 13' mounted on a disc 57 which is adapted to drive a connecting rod 56 connected to a link rod 54 which is in turn connected to two rocking plates 52, 53 which are in turn pivoted at the upper ends to parallel and spaced shafts 50, 51 and the belt 14 is driven from the motor 10 through an endless belt 12 trained about a pulley 11 on the motor 10 and the disc 57 to drive the nip roller assembly, tape traverse mechanism and shaking off device at the same time.

Figure 3:
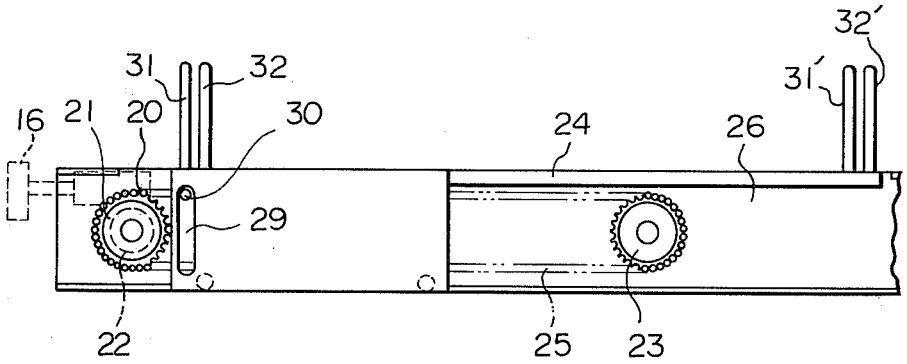
FIG. 3 is a fragmentary front elevational view on an enlarged scale of the traverse mechanism.

As more clearly shown in FIG. 3, the tape traverse mechanism comprises a worm 20 which is driven by the pulley 16, a sprocket wheel 22 adapted to be rotated by a worm wheel 21 meshing with a worm 20, and an endless chain 25 is trained about the sprocket wheel 22 and a sprocket wheel 23 which is mounted on a chain box 26 on one side of which a slide plate 27 is supported for reciprocal movement by the chain 25. The above-mentioned slide plate 27 is provided with a vertical slot 29 for receiving a pin 30 on the chain 25. A horizontal support bar 24 is secured to the slide plate 27 and a first pair of closely spaced guide bars 31, 32 extend uprightly at one end of the support bar 24 and a second pair of closely spaced guide bars 31', 32' extend uprightly at the other end of the support bar 24. The tapes T are guided through the clearances between the pairs of guide bars 31, 32 and 31', 32', respectively, with their breadth disposed uprightly and are guided for traverse movement as the slide plate moves reciprocally.

Rotational movement is imparted to the feed roll 17 as the pulley 15 rotates and the pressure roll 18 is moved into contact with the feed roll 17 with a predetermined pressure by the operation of a handle 19 to pinch the associated tape T therebetween to transfer the tape.

The tape shaking-off-rocking mechanism comprises the above-mentioned parallel and spaced rotary shafts 50, 51 to which the upper ends of the two rocking plates 52, 53 are pivoted to define the tape receiving clearance therebetween just below the nip of the pinch roll assembly. The rocking plates 52, 53 are connected together on their opposing sides by means of the connection linkage 54 which is in turn connected to the disc 57 by means of the connecting rod 56. As the pulley 13 rotates, the rocking plates 52, 53 rock as shown by the solid and two-dot lines in FIG. 2 to shake the tape off which tape is then folded upon itself to form folded layers which adapt to the depth D of the box 9.

Figure 4:
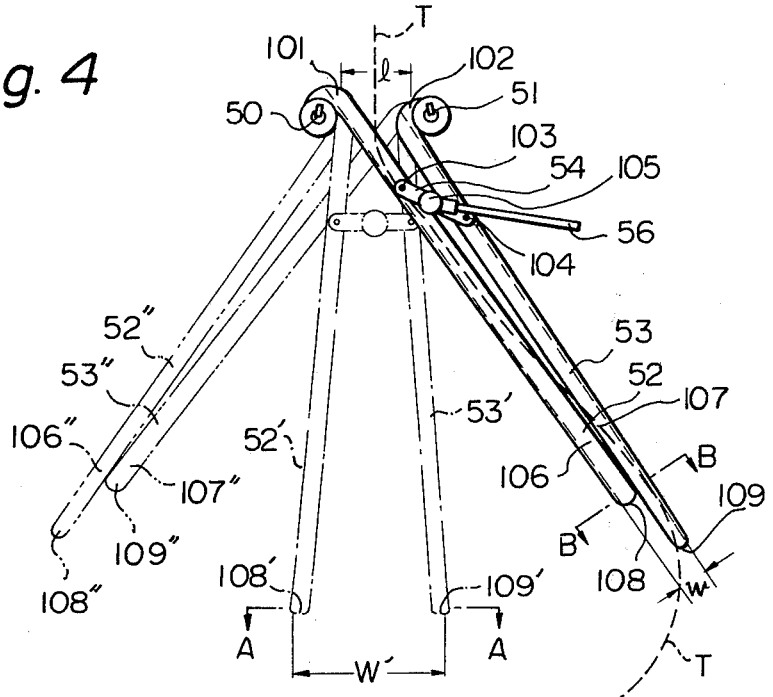
FIG. 4 is a fragmentary side elevational view on an enlarged scale of the tape shaking off mechanism.
Figure 5:
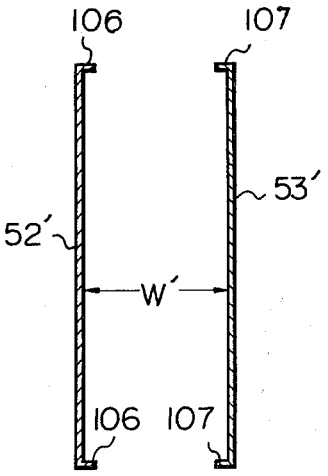
FIG. 5 is a cross-sectional view taken along the line A—A of FIG. 4 and as seen in the arrow direction therein.
Figure 6:
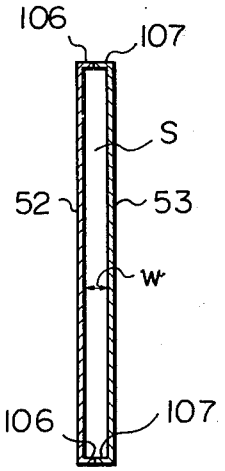
FIG. 6 is a cross-sectional view taken along the line B—B of FIG. 4 and as seen in the arrow direction therein.

To explain the tape shaking-off-rocking mechanism more specifically referring to FIGS. 4 to 6, the rocking plates 52, 53 are pivoted at the upper edges 101, 102 thereof to the shafts 50, 51 which in turn extend parallel to each other and are secured at the opposite ends to the side frames 3, 3. The rocking plates 52, 53 are connected together at their intermediate points between the upper and lower ends thereof by the linkage 54 which is in turn rotatably supported by means of pins 103, 104 on the rocking plates 52, 53. The linkage 54 is operatively connected through a rotary shaft 105 to one end of a connecting rod 56 which is reciprocally moved by a constant stroke given by rotation of the disc 57.

As the rocking plates 52, 53 are rocked from the right-most position as shown by the solid lines through the intermediate position as shown by the one-dot chain lines to the left-most position as shown by the two-dot chain lines by the above-mentioned rotating disc 57 through the connection rod 56, the continuous shake-off-folding-up operation is effected on a tape of indefinite length.

The rocking plates 52, 53 are integrally formed at their opposite side edges with flanges 106, 107, respectively, for preventing the tape from escaping out of the confinement defined by the rocking plates.

And the length of the rocking plates 52, 53 is so selected that the rocking plates are allowed to rock by the disc 57 through the connection rod 56 in conformity with a desired folding-up width for the tape within a rocking movement range determined by the abutting of the flanges 106, 107 at the lower ends against each other.

Since the upper edges 101, 102 of the rocking plates 52, 53, respectively, are pivoted to the parallel shafts 50, 51, respectively, the distance between the upper edges of the rocking plates 52, 53 is always maintained at the constant value l regardless of rocking movement. However, in the position of the rocking plates at one extreme of the rocking movement as shown by the solid lines in FIG. 4, the lower ends 108, 109 of the rocking plates 52, 53 almost contact each other to define a flattened rectangular narrow opening S of the width w between the inner surfaces of the rocking plates 52, 53 as shown in FIG. 6 and in the position of the rocking plates 52, 53 as shown by the solid lines in FIG. 4, the lower end 109 of the rocking plate 53 which is disposed above and outward of the rocking plate 52 extends downwardly beyond the lower end 108 of the inner rocking plate 52. In the opposite extreme of the rocking movement of the rocking plates 52, 53 as shown by the two-dot chain lines in FIG. 4, the disposition of the lower ends 108'', 109'' of the rocking plates 52'', 53'' is reversed.

In the intermediate position of the opposite rocking extremes of the rocking plates, as shown by the one-dot chain lines in FIG. 4, the distance and angle between the inner surfaces of the rocking plates 52', 53' increases continuously so that the distance between the rocking plates at their lower ends 108', 109' takes maximum value W' at the midpoint of the rocking movement.

With the above-mentioned construction and arrangement of the shake-off-folding-up device, when a tape T of indefinite length (as shown by the dotted lines in FIG. 4) is continuously fed at a predetermined rate into and through the tape guide passage or opening defined by the opposite rocking plates 52, 53, the plates 52, 53 rock at an angular velocity and the predetermined rocking range in conformity with the feed rate of the tape while guiding the tape through the guide passage or opening defined by the opposing surfaces of the plates 52, 53 to shake the tape off and stack it within the box below the tape shake-off device.

At this time, depending upon material and or shape of the tape, even when the distance between the inner or guide surfaces of the opposite rocking plates 52, 53 may reduce to the degree that the tape would not momentarily move downwardly and accumulate itself in the guide passage or opening, the rocking plates 52, 53 increase the width of the guide opening defined therebetween soon after the momentary narrowing of the opening as the plates continue to rock to thereby eliminate the accumulation of the tape within the opening and as a result, the successive shaking off of the tape can be effected without substantially disturbing the folded-up condition of the tape. The shaking-off mechanism above stated is preferably employed in the invention, but any other conventional rockable shaking-off mechanism can be, of course, employed.

Between and on the outer sides of the lower side frames 4, 4 a mechanism is provided which is adapted to press against the tops of the stacks of folded tapes within the accumulation boxes 9, 9'.

More particularly, two parallel rotary shafts 64, 74 extend between and are suitably journalled in the lower side frames 4, 4 in a position just above the front upper edges 81 of the accumulation boxes 9, 9'. Pressure plates 5, 7 having the width substantially corresponding to one half of the width W of the accumulation boxes 9, 9' are secured on the rotary shaft 64 whereas two pressure plates 6, 8 similar to the pressure plates 5, 7 are secured on the rotary shaft 74. One end or the left-hand end (FIG. 1) of the rotary shaft 64 protrudes outwardly of the associated side frame 4 and has an arm 63 secured thereto. The end of the arm 63 is pivoted to the outer end of the piston rod 62 of an air cylinder 60 which is in turn pivoted to a rotary shaft 61 secured to the adjacent vertical frame 2. One end of right-hand end (as seen in FIG. 1) of the rotary shaft 74 protrudes outwardly of the associated side frame 4 which opposes the side frame 4 from which the above-mentioned end of the rotary shaft 64 extends and has an arm 73 longer than the arm 63 secured thereto. The end of the arm 73 is pivoted to the outer end of the piston rod 72 of an air cylinder 70 which is in turn pivoted to a shaft 71 secured to the associated vertical frame 2.

The pressure plates 5, 7 and pressure plates 6, 8 are connected to the rotary shafts 64, 74 by means of shorter and longer support arms 65, 75, respectively. The longer arm 75 supporting the pressure plates 6, 8 is provided with a notch 76 in which the rotary shaft 64 is adapted to be received when the pressure plates 6, 8 are pivoted from the upright one-dot line position as shown in FIG. 2 to the horizontal position as shown in FIG. 1.

Therefore, when the air cylinders 60, 70 are actuated, the pressure plates 5, 7 and pressure plates 6, 8 are rocked between the upright and horizontal positions, respectively, to cover the area corresponding to one half of the upper opening area of the tape accumulation boxes 9, 9', respectively.

With the above-mentioned construction and arrangement of the components of the apparatus of the embodiment, in operation, when the two boxes 9, 9' are properly positioned in predetermined positions within the apparatus, the two tapes T are guided about the stepped tension regulator guide roll C and passed through the clearances defined between the upright guide bars 31, 32 and 31', 32' of the traverse mechanism, respectively, with their breadth disposed uprightly so that the tapes T are suspended down through the clearances defined between the respectively opposing rocking plates 52, 53 and 52', 53', respectively, while being pinched by the cooperating feed rolls and pressure rolls 17, 18 and 17', 18', respectively. With the tapes T maintained in this condition, when the motor 10 is started, the tapes T are advanced by the rolls 17, 18 which are driven by the belts 12, 14 wrapped about the pulleys 11, 13 and 13', 15, 16, respectively. Simultaneously, the pulley 16, worm 20, worm wheel 21, sprocket wheels 22, 23 and chain 25 are operated to move the pin 30 on the chain 25 which engages in the elongated slot 29 in the slide plate 27 whereby the slide plate 27 moves laterally along the side of the chain box 26. As the slide plate 27 moves, the support bar 24 secured to the slide plate 27 and the upright guide bars 31, 32 and 31', 32' at the opposite ends of the slide plate 27 also move to traverse the tapes T in the axial direction of the feed roll 17 whereby the reciprocal traverse movement of the tapes T is effected while being regulated depending upon the space between the sprocket wheels 22, 23.

Meantime, the two rocking plates 52, 53 also reciprocally rock as shown by the two-dot lines in FIG. 2 on the stroke depending upon the rotation of the disc 57 whereby the tapes T fed between the plates are shaken off in the depth direction D of the accumulation boxes 9, 9' and in succession folded upon themselves within the boxes 9, 9' as shown in FIG. 2 to form tape layers folded to form a zigzag stack in the width direction W of the boxes.

In the tape folding and stacking operation as mentioned hereinabove, the piston rods 62, 67 of the air cylinders 60, 70, respectively, are maintained in their extended positions so that the pressure plates 5, 6, 7, 8 can be maintained in their upright positions until the accumulation boxes 9, 9' are filled with the folded tapes whereby the shaking-off of the tapes will not be impeded.

Figure 8:
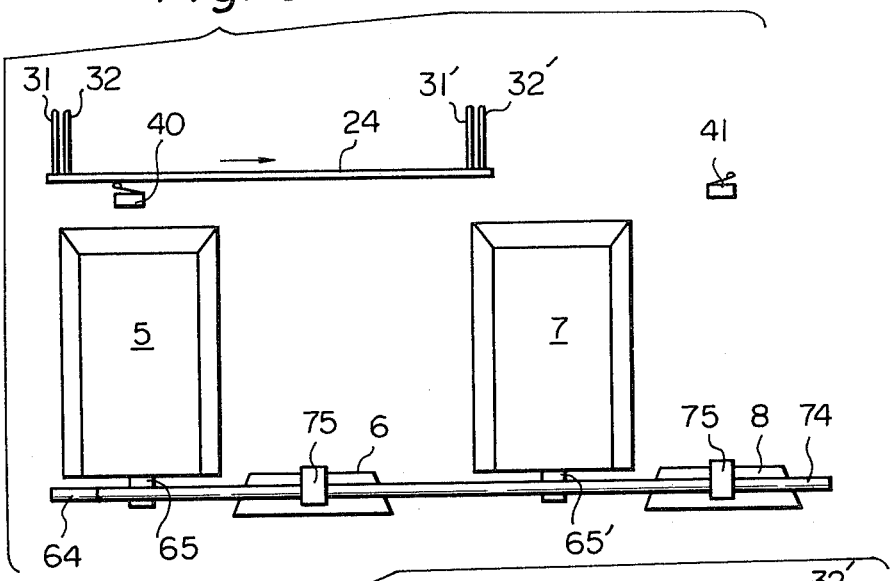
FIGS. 8 and 9 are fragmentary front elevational views on an enlarged scale showing the relationship between the traverse mechanism and pressure plate.
Figure 9:
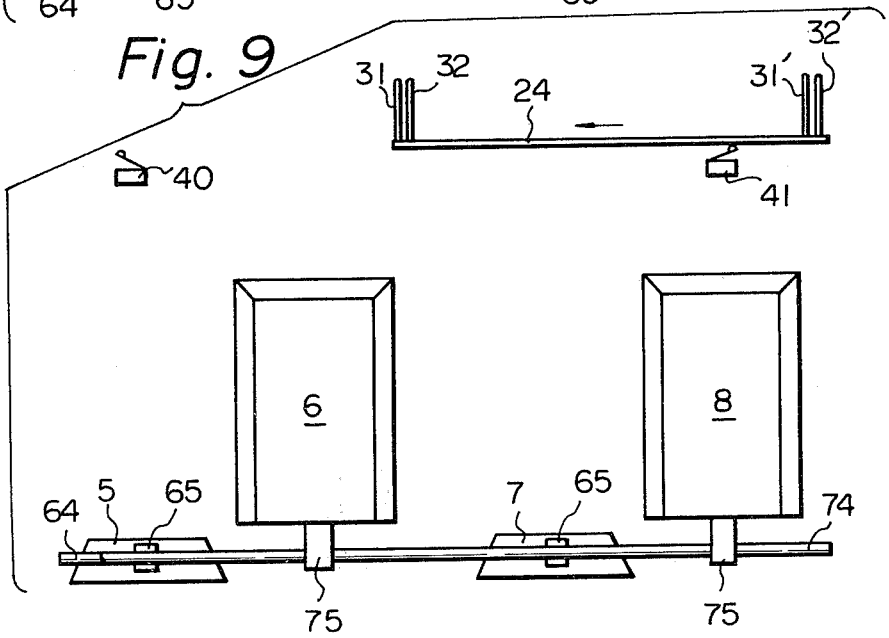

In FIG. 1, reference numerals 40, 41 denote microswitches which are adapted to detect the opposite ends of the support bar 24 having the guide bars 31, 32 and 31', 32' at the opposite ends, respectively, when the bar 24 reaches either extreme of its traverse movement stroke. The microswitches 40, 41 are connected to their associated counters which count the number of traverse movements of the support bar 24 during the tape stacking operation as mentioned hereinabove. The counters have stored therein the number of traverse movements to indicate when the top of the stack of folded tapes T is positioned above the upper edges 81 of the accumulation boxes 9, 9'. When the number of traverse movements reaches the stored value in the counters, the compressed air supply control system for the air cylinders is actuated and as shown in FIGS. 8 and 9, the operation of the control system is so related to the operation of the above-mentioned microswitches 40, 41 that during the tape folding and stacking operation, the pressure plates 6, 8 adapted to press against the tape stacked in one half portion of the width W of the associated accumulation box fall down when the tape is not shaken off in the half portion of the box whereas the other pressure plates 5, 7 are erected and as the tape traverse movement proceeds, when the tape is shaken off in the half portion of the width of the box, the pressure plates 6, 8 are then erected and the now erect pressure plates 5, 6 fall down, and thus, the pressure plate erecting and falling-down operations are timed so as not to impede the traverse and shaking-off-stacking operations of the tape T. In such a time, the rocking movement of the pressure plates 5, 6, 7, 8 is performed each time the microswitches 40, 41 detect or when the microswitches detect two or more times depending upon the condition and/or property of the tape.

Figure 7:
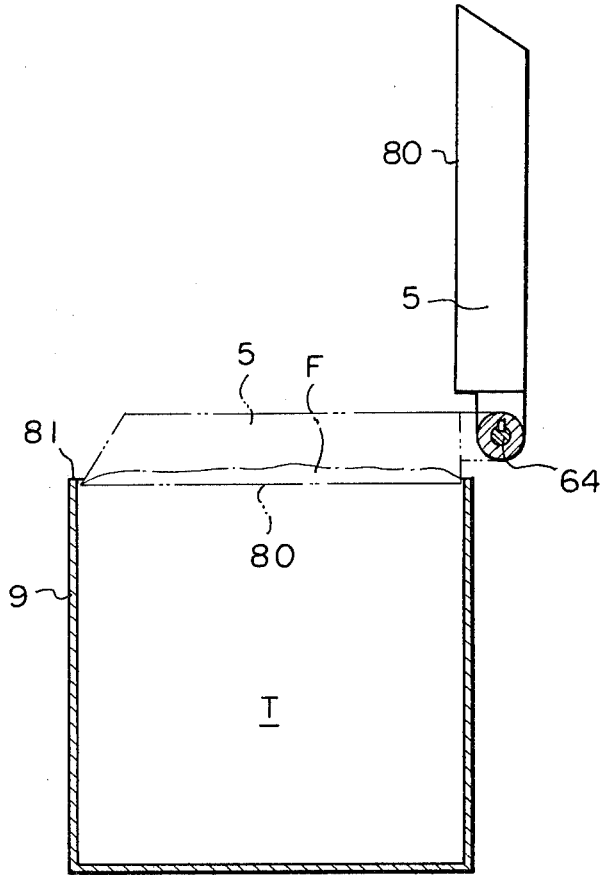
FIG. 7 is a fragmentary side elevational view showing the operation of the pressure plate.

FIG. 7 is a view showing the pressing step. When the top F of the tape stack reaches a position above the height of the upper edge 81 of the accumulation box 9, the pressure plate 5 falls down as shown by the two-dot chain line and the flat pressure face 80 of the pressure plate 5 presses the top F of the tape stack down to the position as shown by the line 80' which is below the upper edge 81 of the box 9 whereupon the pressure plate 5 erects itself to the upright position and the succeeding tape section is folded onto the top F of the previous tape stack. By repeating the pressing and stacking procedure, all of the tape stacked in the box can be compressed to gradually increase the compactness of the tape stack. In this way, any abrupt compression on the take stack is avoided to thereby eliminate possible unnatural distortion and/or creasing of the tape.

According to the apparatus of the present invention, the amount of tape stacked in the accumulation boxes exceeds four times that of the conventional accumulation boxes into which the tape is accumulated therein by only the shaking-off and folding and two times that in the conventional roller pressing-folding method. In addition, the tape feed speed in the apparatus of the invention is quite high and irregular folding and clinging of tape about rollers which were seen in the conventional apparatus of the type are eliminated.

As is clear from the foregoing description, according to the apparatus of the invention, not only is the amount of tape stacked in the accumulation boxes increased, but also the tape accumulation speed is increased and thus, the efficiency of the apparatus is enhanced in comparison to conventional apparatus of this type to greatly contribute to the industry.

What is claimed is:

1. An apparatus for stacking a tape of indefinite length in folded condition comprising a machine base; frames secured on said base; a tape accumulation box mounted on said base and having lateral width-wise adjacent half spaces in said box; means supported on said frames above said box for traversing tape supplied from a source in the lateral width direction of said box; means for feeding the tape from said source into the apparatus; means supported on said frames above said box for shaking tape supplied from said tape feeding means off in a longitudinal depth direction of said box, laterally transverse to said width direction, to thereby stack the tape in folded condition in said box; said apparatus being characterized by means comprising a pair of pivotable pressure plates; means for pivoting said pressure plates to alternately intermittently press down on the top of said tape stack respectively in one half space and the other half space in said box while stacking of said tape occurs in the corresponding opposed half space when the height of the tape stack is above the top of said box to thereby gradually compress the tape stack in said box as said tape is being stacked.

2. The apparatus of claim 1, wherein said tape traversing means, said tape feeding means and said tape shaking off means are driven from a common drive means.

3. The apparatus of claim 1, wherein each of said pressure plates is supported on a rotating shaft horizontally and pivotally mounted on said frames and is rockable between substantially upright position and substantially horizontal folded down position.

4. The apparatus of claim 3, wherein each of said pressure plates is actuated by an air cylinder mounted on said frames.

5. The apparatus of claim 4, wherein said air cylinder is adapted to be actuated after counting a predetermined number of traverse movements of said tape traversing means.

6. The apparatus of claim 1, wherein said pair of pressure plates are subjected to a rocking movement in association with the traverse movement of said tape traversing means.

7. The apparatus of claim 1, wherein said tape shaking off means comprises a pair of spaced parallel shafts horizontally supported on said frames; a pair of rocking plates each pivoted to one of said shafts at the upper edge thereof; a linkage for pivotably interconnecting said rocking plates at intermediate positions between the upper and lower ends of the same; and a connecting rod for connecting said linkage to rocking drive means; said rocking plates defining a tape guide passage there between.

8. The apparatus of claim 7, wherein the distance between said rocking plates at their lower ends is furthest intermediate of the rocking movement and closest at the opposed extremes of the rocking movement.

9. The apparatus of claim 7, wherein each of said rocking plates has flanges integrally formed on both sides of said plates.

10. The apparatus of claim 7, wherein said rocking drive means comprises a rotating disc.

11. The apparatus of claim 1, wherein said tape traversing means comprises; a pair of sprocket wheels spaced to each other and supported on said frames; a chain wrapped around said sprocket wheels; a slide plate transversely and slidably supported on said frames and engaged to said chain; and tape guide bars supported on said slide plate.

* * * * *

UNITED STATES PATENT AND TRADEMARK OFFICE

CERTIFICATE OF CORRECTION

PATENT NO. : 4,427,404

DATED : January 24, 1984

INVENTOR(S) : YASUO YAMADA

It is certified that error appears in the above—identified patent and that said Letters Patent is hereby corrected as shown below:

On the title page:
The priority information should be corrected as follows:

[30] Foreign Application Priority Data
Dec. 25, 1980 [JP] Japan .....55-18290
Jan. 5, 1981 [JP] Japan .....56-4

Signed and Sealed this

*Seventh* Day of *August 1984*

[SEAL]

*Attest:*

GERALD J. MOSSINGHOFF

*Attesting Officer*

*Commissioner of Patents and Trademarks*